US005101589A

United States Patent [19]

Duncan

[11] Patent Number: 5,101,589

[45] Date of Patent: Apr. 7, 1992

[54] ILLUMINATED ORDNANCE ORGANIZATION

[76] Inventor: Richard V. Duncan, P.O. Box 3275, Sedona, Ariz. 83640

[21] Appl. No.: 682,340

[22] Filed: Apr. 9, 1991

[51] Int. Cl.[5] ..... F41C 23/10

[52] U.S. Cl. ..... 42/71.02; 42/1.01; 42/100; 33/241

[58] Field of Search ..... 42/1.01, 71.02, 100; 33/241

[56] References Cited

U.S. PATENT DOCUMENTS 3,999,321 12/1976 Musgrave ..... 42/1.01

4,586,282 5/1986 Sniezak ..... 42/71.02

*Primary Examiner*—Michael J. Carone

*Attorney, Agent, or Firm*—Leon Gilden

[57] ABSTRACT

A firearm is provided with a handle frame and a receiver frame, wherein the invention includes illuminated indicators in varying configurations to include a descending order of lined length along a rear wall of the handle frame and on each side wall of spaced side walls of the handle frame. A modified form of the invention further includes luminescent indicators aligned with rear and forward sight members of the firearm mounted on the top wall of the receiver frame.

6 Claims, 6 Drawing Sheets

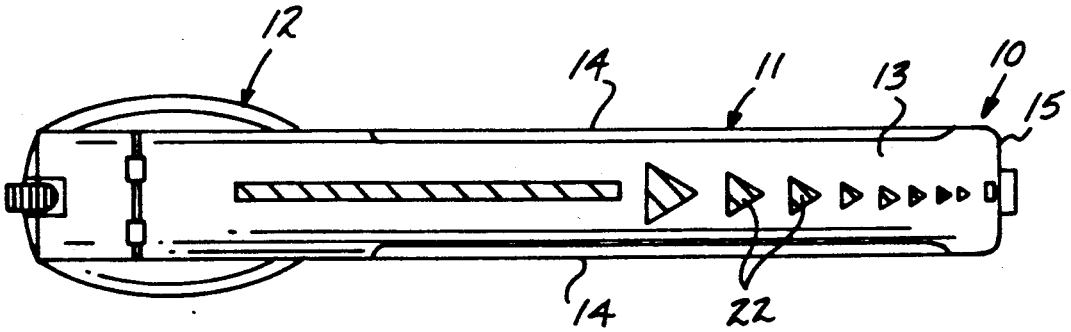
Fig 7
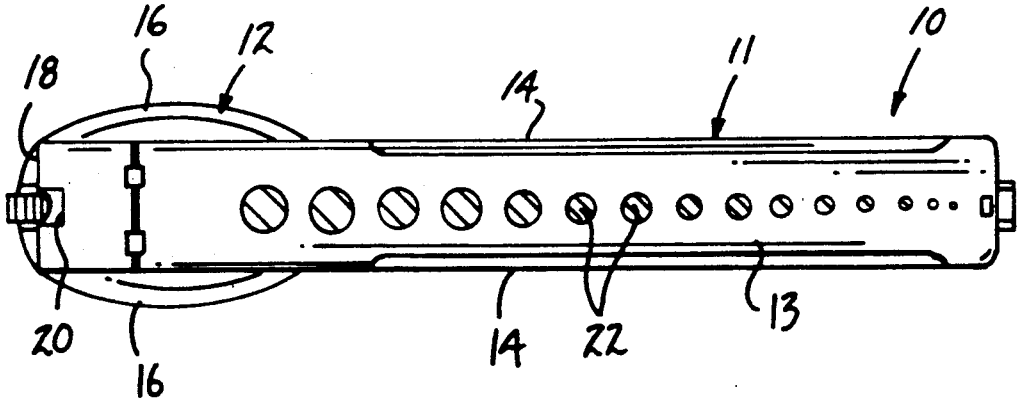
Fig 8
Fig 9
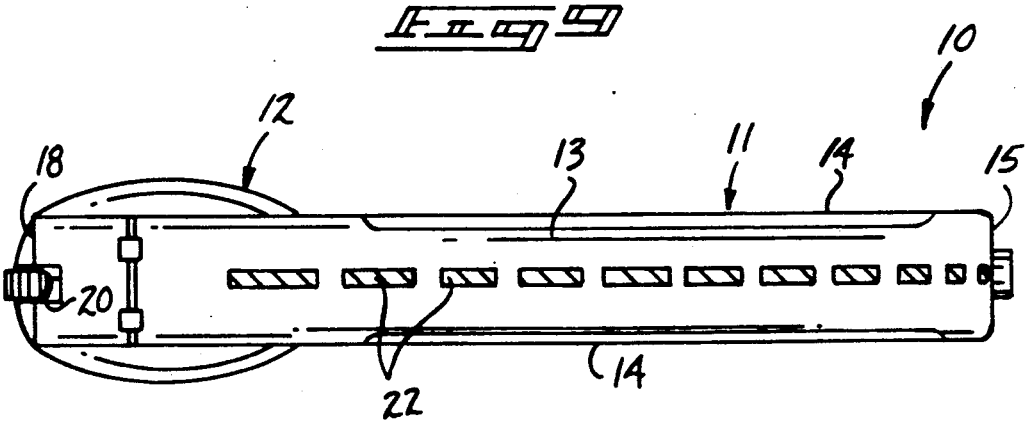

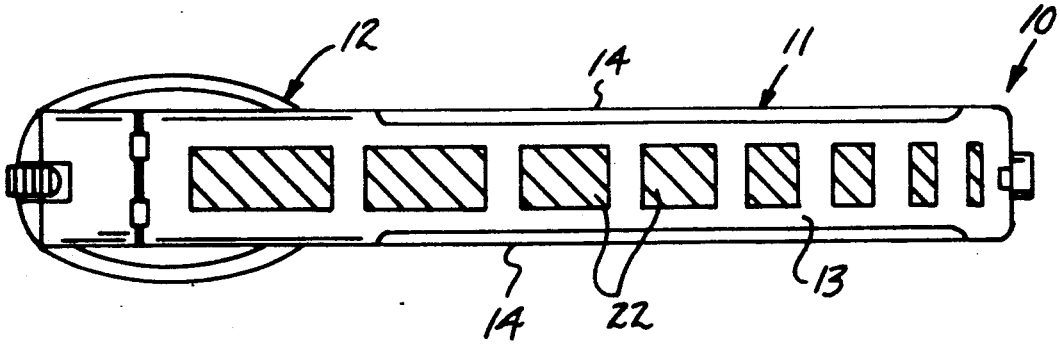
FIG 10
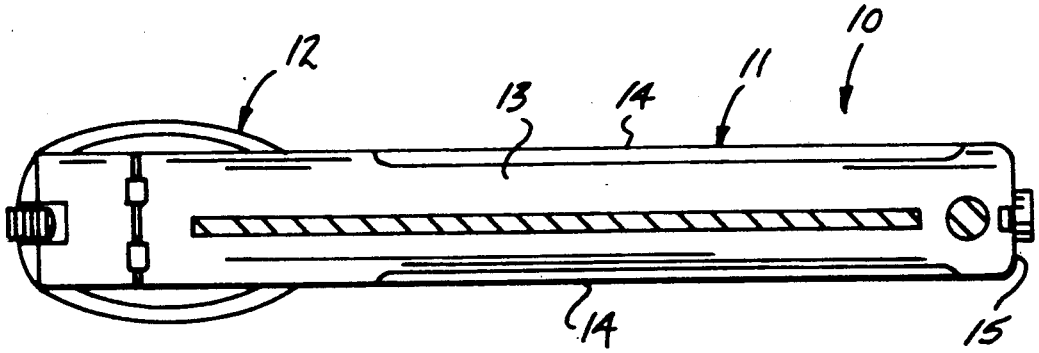
FIG 11
FIG 12
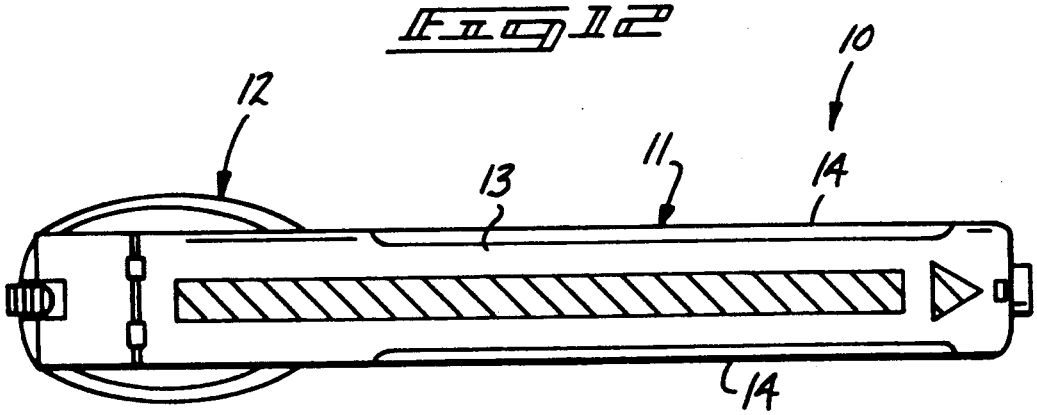

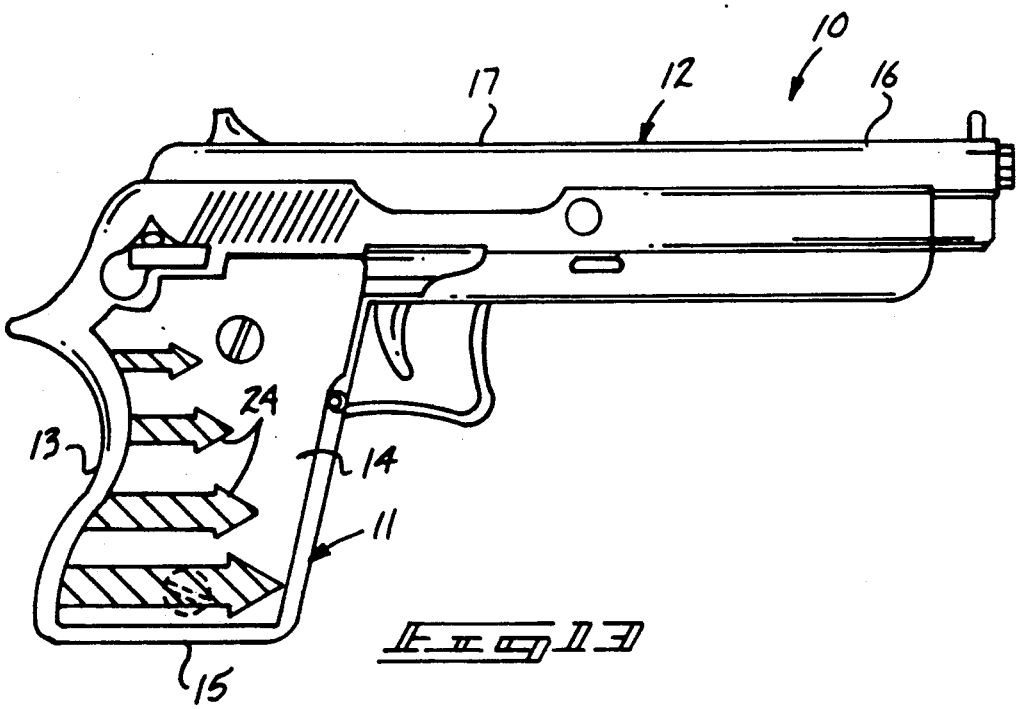
Fig 13
Fig 14
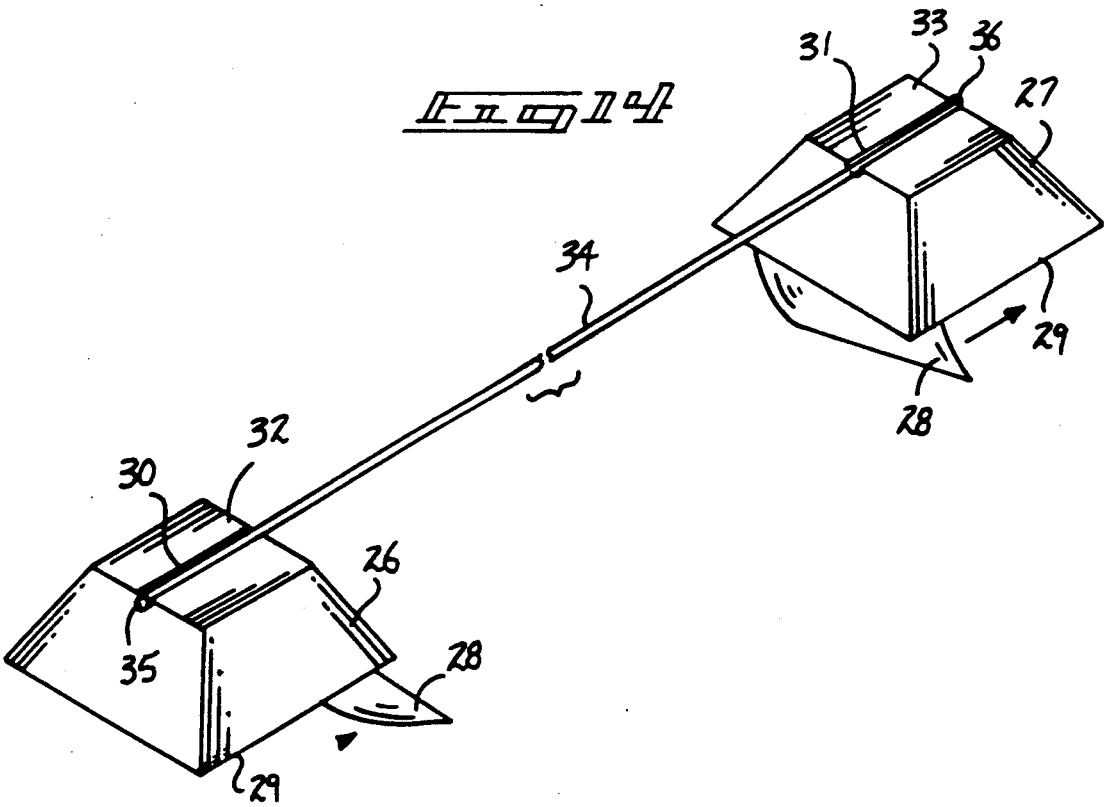

ILLUMINATED ORDNANCE ORGANIZATION

BACKGROUND OF THE INVENTION

1. Field of the Invention

The field of invention relates to weaponry, and more particularly pertains to a new and improved illuminated ordnance organization wherein the same provides for visual orientation, as well as proper visual position referencing as to alignment of a weapon utilized in conditions of limited light availability.

2. Description of the Prior Art

While various illuminated sights and the like have been utilized in the prior art of ordinance, the proper grasping and orientation of a weapon during conditions of limited available light provides a hazard to an operator of a weapon. The instant invention attempts to overcome deficiencies of the prior art by providing proper orientation and position referencing in the use and application of an ordnance firearm during conditions of limited light availability. Examples of prior art ordinance weaponry utilizing illuminated portions includes U.S. Pat. No. 4,574,335 to Frimer wherein a luminescent gun sight apparatus is provided.

U.S. Pat. No. 4,601,121 to Jolly sets forth a gun sight utilizing a ramp, wherein the top surface of the ramp is formed optionally of luminescent material.

U.S. Pat. No. 4,646,208 to Hayashi wherein a self-propelled vehicle includes a light-transmitting body mounted on a vehicle to provide proper indication and orientation of the vehicle in use, particularly mounting the device on a forward portion of a vehicular hood.

As such, it may be appreciated that there continues to be a need for a new and improved illuminated ordnance organization as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of illuminated weaponry now present in the prior art, the present invention provides an illuminated ordnance organization wherein the same utilizes illuminated indicator members of varying configurations, e.g. decreasing lineal length, to provide proper orientation of a weapon during use in conditions of limited light availability. As such, the general purpose of the present invention, which will be described subsequently in greater detail, is to provide a new and improved illuminated ordinance organization which has all the advantages of the prior art illuminated weaponry and none of the disadvantages.

To attain this, the present invention provides a firearm with a handle frame and a receiver frame, wherein the invention includes illuminated indicators in varying configurations along a rear wall of the handle frame and on each side wall of spaced side walls of the handle frame for orientation. A modified form of the invention further includes luminescent indicators aligned with rear and forward sight members of the firearm mounted on the top wall of the receiver frame for position referencing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of or incorporation in other structures, methods and systems for carrying out the concept of orientation and position referencing of components in conditions of limited light environments. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved illuminated ordnance organization which has all the advantages of the prior art illuminated weaponry and none of the disadvantages.

It is another object of the present invention to provide a new and improved illuminated ordnance organization which may be easily and efficiently manufactured and marketed.

It is a further object of the present invention to provide a new and improved illuminated ordnance organization which is of a durable and reliable construction.

An even further object of the present invention is to provide a new and improved illuminated ordnance organization which is susceptible of a low cost of manufacture with regard to both materials and labor, and which accordingly is then susceptible of low prices of sale to the consuming public, thereby making such illuminated ordnance organizations economically available to the buying public.

Still yet another object of the present invention is to provide a new and improved illuminated ordnance organization which provides in the apparatuses and methods of the prior art some of the advantages thereof, while simultaneously overcoming some of the disadvantages normally associated therewith.

Still another object of the present invention is to provide a new and improved illuminated ordnance organization wherein the same sets forth luminescent elements adherably mounted to exterior surface portions of a firearm or other components to provide indication of proper orientation in use and position referencing of the firearm or component during conditions of limited light availability.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 7–12 are each of a rear orthographic view mounting the luminescent elements to a rear wall of a handle frame of a firearm.

FIG. 13 is an orthographic side view, taken in elevation, of further luminescent indicator elements mounted to each side wall of the handle frame of the firearm.

FIG. 14 is an isometric illustration of a receiver sight member for mounting to a top wall of the receiver frame of an associated firearm.

DESCRIPTION OF THE PREFERRED EMBODIMENT

Figure 1:
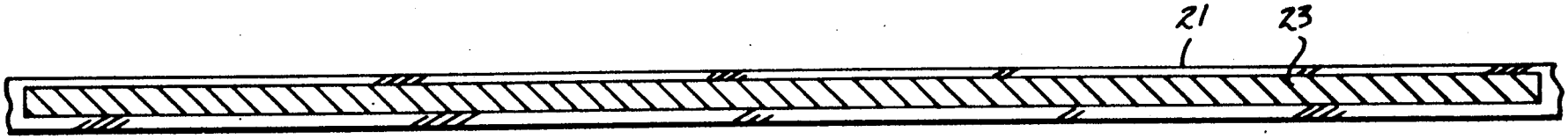
FIGS. 1–6 are top orthographic views of an elongate, polymeric web mounting various configurations of luminescent indicator elements of decreasing lineal length.
Figure 2:
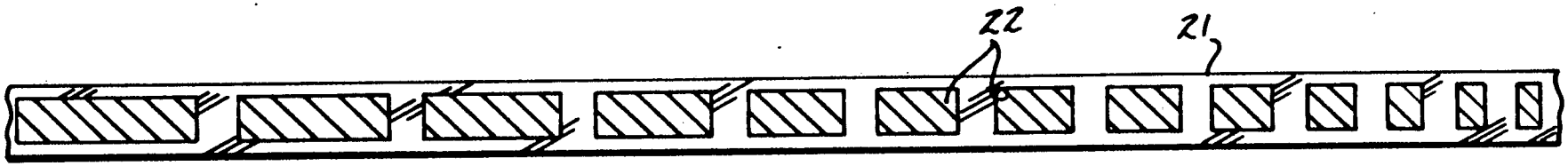
Figure 3:
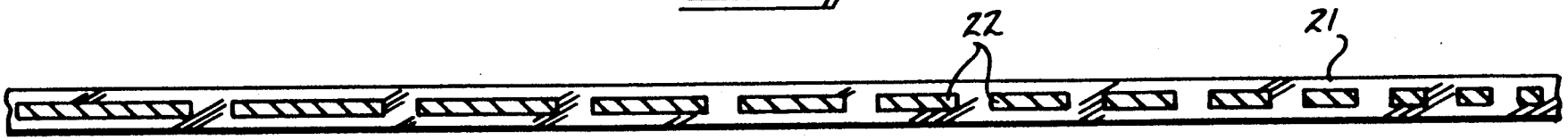
Figure 4:
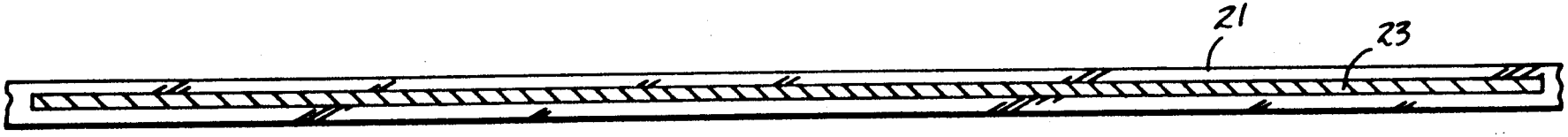
Figure 5:
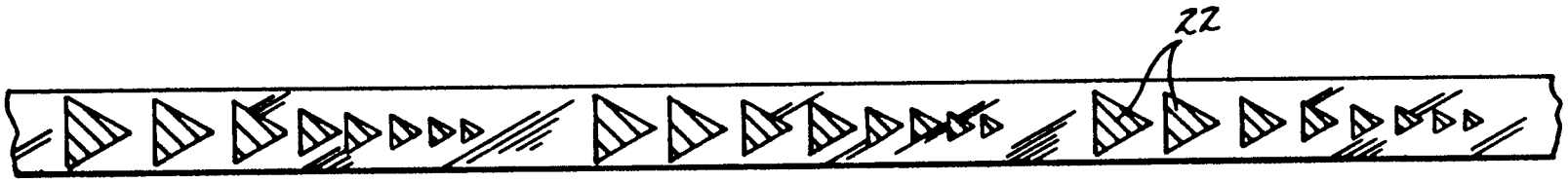
Figure 6:
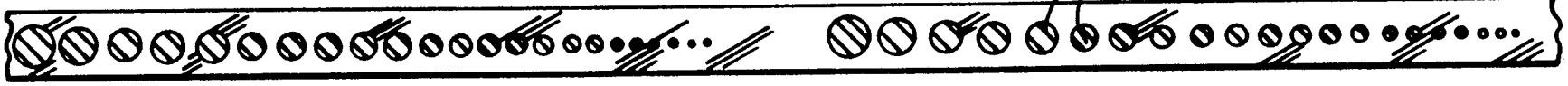

With reference now to the drawings, and in particular to FIGS. 1 to 16 thereof, a new and improved illuminated ordnance organization embodying the principles and concepts of the present invention and generally designated by the reference numeral 10 will be described.

More specifically, the illuminated ordnance organization 10 of the instant invention essentially comprises an ordnance weapon, including a handle frame 11 fixedly mounted in cooperation with a receiver frame 12. The firearm, such as is exemplified in FIGS. 7–12, 13, and 15, is arranged for the feeding and firing of a projectile therefrom in a conventional manner. The handle frame 11 includes a handle frame rear wall 13, with spaced handle frame side walls 14 and a handle frame bottom wall 15. The receiver frame 12 includes receiver frame side walls 16 and a receiver frame top wall 17. The receiver frame top wall 17 mounts a rear sight 18 and a forward sight 19 adjacent rear and forward terminal ends of the receiver frame top wall 17. The rear sight 18 includes a rear sight notch 20 directed medially through a top edge of the rear sight 18 for alignment of the forward sight.

Illumination members utilized by the firearm of the instant invention includes an elongate, polymeric web 21 (see FIGS. 1–6 for example), each including selective patterns of removably mounted self-adhesive luminescent first decal members 22 mounted thereon. The decal members are formed with a self-adhering surface for securement to the handle frame rear wall 13 defining a pattern of decreasing decal members directed from an intersection of the handle frame rear wall 13, with the receiver frame 12 towards the handle frame bottom wall 15. The decreasing sizes of the first decal members 22 mounted on the handle frame rear wall 13 provides proper orientation of the handle frame bottom wall relative to the receiver frame 12. The use of a single, elongate decal strip 23 (see FIG. 1) may be utilized wherein the single strip must subsequently be severed or utilized in combination with first decal members of a decreasing length. Second luminescent decal members 24 are mounted to each handle frame side wall 14 (see FIG. 13) and are each of a decreasing lineal length and are arranged parallel relative to one another, typically with arrows at their forward terminal ends for proper orientation of a forward end of the pistol to minimize danger in use of the pistol during conditions of limited light, as well as proper orientation of the pistol prior to its grasping by an individual.

Figure 15:
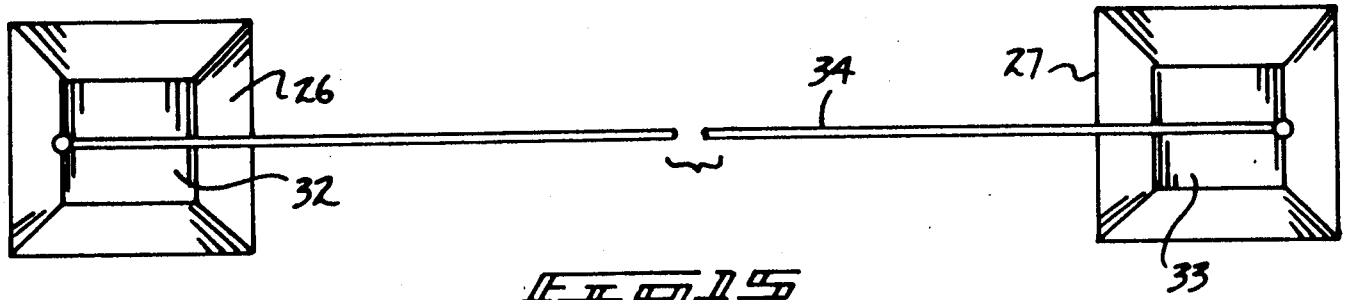
FIG. 15 is an orthographic top view of the sight member, as set forth in FIG. 14.
Figure 16:
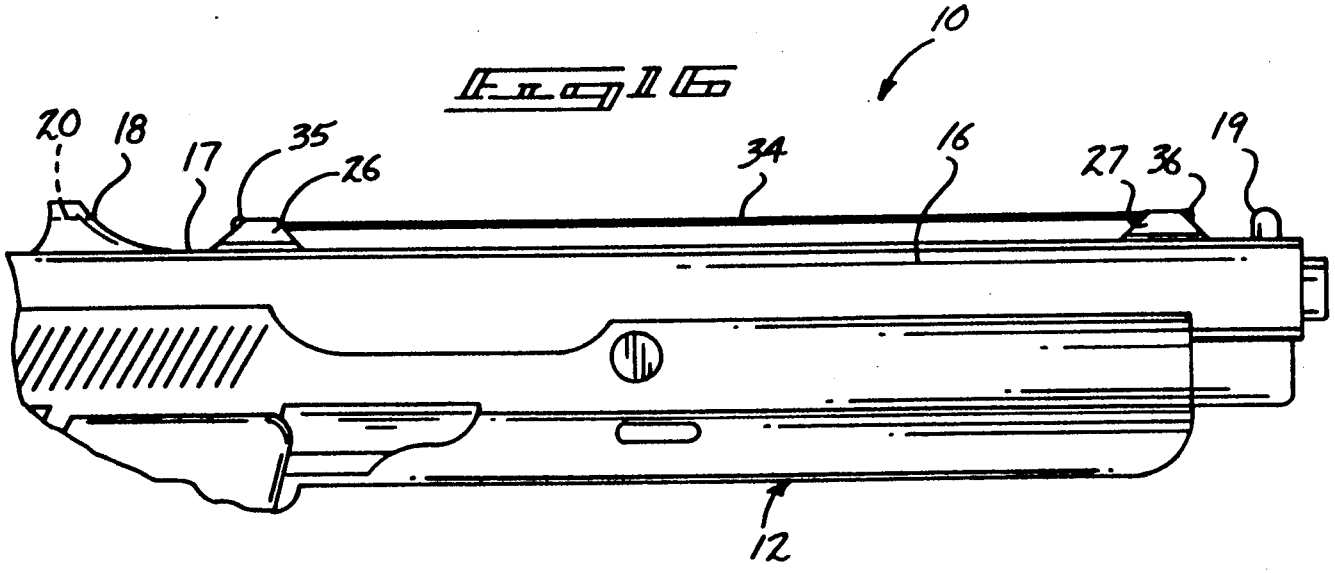
FIG. 16 is an orthographic side view, taken in elevation, of the sight member mounted to the top wall of the receiver frame.

FIGS. 14–16 illustrate the use of a top sighting member for mounting to the receiver frame top wall 17. The top sighting member includes a first mounting block 26 spaced from a second mounting block 27. Each mounting block includes an adhesive exposing peel-away web 28 mounted to each respective mounting block adhesively coated bottom wall 29. A first groove 30 formed within a first mounting block top wall 32 is coaxially aligned with a second groove 31 formed within a second mounting block top wall 33. The coaxially aligned grooves 30 and 31 fixedly mount therewithin each end portion of a luminescent rod 34. The luminescent rod 34 includes a forward cylindrical tip 35 and a rear cylindrical tip 36 to enhance light projection during periods of limited light availability. It should be further noted that the luminescent rod 34 is aligned with the rear sight dots 20 and an upper portion of the forward sight 19. The luminescent rod 34 is translucent for use during daylight hours or when available light is adequate for sighting. During conditions of limited light, the luminescent rod provides alignment of the receiver to permit sighting and discharge of the weapon in proper alignment with a target.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated ordnance organization including a handle frame and a receiver frame, with the handle frame fixedly mounted to the receiver frame, with the handle frame including a handle frame rear wall, handle frame side walls, and a handle frame bottom wall, and the receiver frame including receiver frame side walls and a receiver frame top wall coextensive with and overlying the side walls, and a rear sight mounted adjacent a rear terminal end of the receiver frame top wall, and a forward sight mounted adjacent the forward terminal end of the receiver frame top wall, and first indicator members mounted coextensively of the handle frame rear wall, and wherein the first indicator members are illuminated.

2. An apparatus as set forth in claim 1 wherein the first indicator members are of a decreasing length along the handle frame rear wall from the receiver frame to the handle frame bottom wall.

3. An apparatus as set forth in claim 2 including second indicator members mounted to each handle frame side wall, wherein the second indicator members are parallel relative to one another and are luminescent, and are further defined as arrows indicating a forward terminal end of the receiver frame.

4. An apparatus as set forth in claim 3 including further sight means mounted between the rear sight and the forward sight for providing sighting of the firearm during conditions of limited light availability.

5. An apparatus as set forth in claim 4 wherein the further sighting means includes a first mounting block and a second mounting block, the first mounting block including a first mounting block top surface, and the second mounting block including a second mounting block top surface, wherein the first mounting block top surface includes a first groove and the second mounting block top surface includes a second groove, wherein the first and second grooves are coaxially aligned relative to one another, with the first block mounted adjacent the rear sight between the rear sight and forward sight, and the second block mounted on the receiver frame top wall adjacent the forward sight between the rear sight and the forward sight.

6. An apparatus as set forth in claim 5 including an elongate, luminescent rod mounted within the first groove and the second groove, wherein the luminescent rod includes a rear cylindrical tip projecting rearwardly of the first groove and including a forward cylindrical tip mounting forwardly of the second groove, wherein the luminescent rod is aligned with a rear sight notch formed within the rear sight.

* * * * *